US010847130B2

(12) United States Patent
Terai et al.

(10) Patent No.: US 10,847,130 B2
(45) Date of Patent: Nov. 24, 2020

(54) KEYBOARD DEVICE INCLUDING LINK MECHANISM

(71) Applicant: KABUSHIKI KAISHA KAWAI GAKKI SEISAKUSHO, Hamamatsu (JP)

(72) Inventors: Yasushi Terai, Hamamatsu (JP); Mikhail Vasilievich Pletnev, Basel (CH); Anton Anatolievich Nikitin, Moscow (RU); Hideyuki Ishida, Hamamatsu (JP)

(73) Assignee: KABUSHIKI KAISHA KAWAI GAKKI SEISAKUSHO, Hamamatsu (JP)

( * ) Notice: Subject to any disclaimer, the term of this patent is extended or adjusted under 35 U.S.C. 154(b) by 0 days.

(21) Appl. No.: 16/572,431

(22) Filed: Sep. 16, 2019

(65) Prior Publication Data

US 2020/0090633 A1 Mar. 19, 2020

(30) Foreign Application Priority Data

Sep. 19, 2018 (JP) ..... 2018-174475
Jun. 28, 2019 (JP) ..... 2019-121269

(51) Int. Cl.
*G10H 1/34* (2006.01)

(52) U.S. Cl.
CPC ..... *G10H 1/346* (2013.01); *G10H 2220/221* (2013.01)

(58) Field of Classification Search
CPC ..... G10H 1/346; G10H 2220/221
See application file for complete search history.

(56) References Cited

U.S. PATENT DOCUMENTS 6,139,207 A * 10/2000 Kawabe ..... G06F 1/1616 200/341
2006/0272469 A1* 12/2006 Meisel ..... G10F 1/02 84/21
2010/0071532 A1* 3/2010 Kitajima ..... G10H 1/346 84/432
2015/0294650 A1* 10/2015 Nishida ..... G10C 3/125 84/433

FOREIGN PATENT DOCUMENTS

JP 2010-286694 A 12/2010

* cited by examiner

*Primary Examiner* — Jeffrey Donels
(74) *Attorney, Agent, or Firm* — Lewis Roca Rothgerber Christie LLP

(57) ABSTRACT

A keyboard device having keys enabling sufficient weight of touch to be obtained in spite of being configured to be shorter in length than those of the grand piano and. Link mechanisms are each provided on a base for supporting an associated one of the keys from below and configured to cause the associated key to operate such that when a front end of the key is depressed, an amount of downward movement of a rear end of the key becomes approximately half of an amount of downward movement of the front end of the key. Each link mechanism includes front-side and rear-side key link bars and front-side and rear-side connecting link bars. The front-side and rear-side connecting link bars are pivotally supported, respectively, and are pivotally and slidably connected to each other via respective rear and front ends thereof.

8 Claims, 6 Drawing Sheets

KEYBOARD DEVICE INCLUDING LINK MECHANISM

CROSS-REFERENCE TO RELATED APPLICATION(S)

This application claims priority to Japanese Patent Application Number 174475/2018, filed on Sep. 19, 2018, and Japanese Patent Application Number 121269/2019, filed on Jun. 28, 2019, the entire contents of all of which are incorporated herein by reference.

BACKGROUND OF THE INVENTION

Field of the Invention

The present invention relates to a keyboard device which is applied to an electronic keyboard instrument and the like, and realizes the same key operation as that of an acoustic grand piano, by using keys relatively short in length.

Description of the Related Art

In general, in a keyboard device of an acoustic grand piano, keys are configured to be relatively long (e.g. 50 to 60 cm) such that they each swing about an associated balance pin located at about the longitudinal center thereof. When a keyboard device having such long keys is applied e.g. to an electronic piano, the depth of the electronic piano is increased. Therefore, conventionally, as a keyboard device configured to have keys reduced in length, there has been known one disclosed e.g. in Japanese Laid-Open Patent Publication No. 2010-286694.

This keyboard device is comprised of a frame having a predetermined shape, abase end portion provided at a rear end of the frame, a plurality of keys arranged forward of the base end portion in a state each extending in a front-rear direction and juxtaposed in a left-right direction, and link portions provided between the keys and the above-mentioned base end portion. Further, an electronic circuit board is provided on the frame, and on the electronic circuit board, there are arranged a plurality of key switches on a key-by-key basis. Each key is placed on an associated one of the key switches at about the longitudinal center of the key.

The link portion provided between a rear end of each key and a front surface of the base end portion is made of resin and integrally formed with the key and the base end portion. Specifically, the link portion is comprised of two arms each extending in the front-rear direction and vertically arranged in a state displaced from each other in the left-right direction. Each arm is formed in a plate shape having a predetermined thickness and has a front-side connection portion continuous with the key and a rear-side connection portion continuous with the base end portion, each of which is formed to be thin by a semicircular recess that opens downward.

In the keyboard device configured as above, when a front end of a key is depressed, the key pivotally moves downward about the rear-side connection portions of the two arms of an associated link portion. Further, in this case, the front-side and rear-side connection portions of the arms function as hinges, whereby compared with a case where the key pivotally moves about the rear end thereof, an amount of downward movement of the key at a predetermined location of a rear portion thereof is increased to reduce a difference between the amount of the downward movement at the rear portion thereof and an amount of downward movement at the front end thereof. As a consequence, the key supported by the above-described link portion operates such that it pivotally moves about a virtual pivot assumed to be located rearward the link portion, and hence it is possible to obtain a keyboard of which the movement of keys is closely analogous to the movement of those of the grand piano, even though the length of each key of the keyboard is shorter than that of each key of the grand piano.

In the above-described conventional keyboard device, however, since each key has a rear end thereof supported in a cantilever state by an associated one of the link portions, and furthermore, each arm of the link portion is made of resin, the movement of the key is liable to become unstable during depression of the key. Further, each arm of the link portion is liable to be deformed due to aging of the keyboard device caused by the long-term use and the like thereof, and particularly, since the front-side and rear-side connection portions of each arm are formed to be thin, there is a fear that the arms suffer cracking or breaking. In such a case, it is impossible to obtain a desired movement of the key. As described hereinabove, in the keyboard device in which the rear end of each key is supported by the above-described resin link portions, it is impossible to stably obtain the same key operation as that of the key of the grand piano over a long term. Further, in the keyboard device described above, it is impossible to obtain sufficient touch weight, which is felt by a fingertip when performing key depression on a keyboard of an acoustic piano, such as a grand piano.

SUMMARY OF THE INVENTION

It is an object of the present invention to provide a keyboard device which not only enables the same key operation as that of a keyboard of a grand piano to be stably obtained over a long term in spite of each key being configured to be shorter in length than a corresponding one of the grand piano, but also is capable of being formed to be compact in depth and further enables sufficient weight of touch to be obtained.

To attain the above object, the present invention provides a keyboard device comprising a base, a plurality of keys provided above the base, each extending a predetermined length in a front-rear direction, the keys being arranged in a state juxtaposed with respect to each other in a left-right direction, and a plurality of link mechanisms each provided on the base, for supporting an associated one of the keys from below, and configured to cause the associated key to operate such that when a front end of the key is depressed, an amount of downward movement of a rear end of the key becomes approximately half of an amount of downward movement of the front end of the key, wherein the link mechanisms each include a front-side support portion and a rear-side support portion provided on the base with a predetermined spacing therebetween in the front-rear direction, a front-side key link bar extending a predetermined length in a vertical direction and having an upper end thereof connected to a front portion of the key, a rear-side key link bar extending a predetermined length in the vertical direction and having an upper end thereof connected to a rear portion of the key, a front-side connecting link bar extending a predetermined length in the front-rear direction, having a front end thereof pivotally connected to a lower end of the front-side key link bar, and a predetermined portion toward a longitudinal center thereof pivotally supported by the front-side support portion, and a rear-side connecting link bar shorter than the front-side connecting link bar and also extending a predetermined length in the front-rear direction, having a rear end thereof pivotally connected to a lower end of the rear-side key link bar, and a predetermined portion toward a longitudinal center thereof pivotally supported by the rear-side support portion, and wherein the front-side connecting link bar and the rear-side connecting link bar are pivotally and slidably connected to each other via a rear end of the front-side connecting link bar and a front end of the rear-side connecting link bar.

With the configuration of this keyboard device, the keys each extending the predetermined length in the front-rear direction are arranged above the base in the state juxtaposed in the left-right direction. Further, the link mechanisms each for supporting an associated one of the keys from below are arranged on the base. With this, differently from the conventional keyboard device in which a rear end of a key is supported in a cantilever state, it is possible to stably support a key during depression thereof, to thereby ensure a stable movement of the key. Further, the above-described link mechanism is configured such that when the front end of the associated key is depressed, the amount of downward movement of the rear end of the key becomes approximately half of the amount of downward movement of the front end of the key.

As described hereinabove, the keyboard device of the general grand piano has keys, each of which is configured to be relatively long (e.g. 50 to 60 cm) such that it swings about a balance pin provided at about the longitudinal center of the key. Further, in such a keyboard device, a portion of the key, exposed to the outside and visible from a player, is approximately half of a portion of the key forward of the balance pin. For this reason, in the keyboard device of the grand piano, e.g. when a key is fully depressed for key depression, causing a front end thereof to be depressed approximately 10 mm, a rear end of the exposed portion of the key is moved downward by approximately 5 mm. That is, during the key depression, an amount of downward movement of the rear end of the exposed portion of the key becomes approximately half of an amount of downward movement of the front end of the key.

Therefore, even though each key of the present invention has almost the same length as the length of the exposed portion of the key of the grand piano, i.e. is configured to be relatively short, the amount of downward movement of the rear end of the key caused by key depression is made approximately half of the amount of downward movement of the front end of the key, by an associated one of the link mechanisms, and hence when a key is depressed, it is possible to realize the same key operation as that of the key of the grand piano.

Each link mechanism supporting an associated key includes the front-side key link bar, the rear-side key link bar, the front-side connecting link bar, and the rear-side connecting link bar, configured as above. Specifically, the upper ends of the front-side key link bar and the rear-side key link bar are connected to the front portion and the rear portion of the key, respectively. Further, the front-side connecting link bar has the front end thereof pivotally connected to the lower end of the front-side key link bar and the predetermined portion toward the longitudinal center thereof pivotally supported by the front-side support portion. On the other hand, the rear-side connecting link bar has the rear end thereof pivotally connected to the lower end of the rear-side key link bar and the predetermined portion toward the longitudinal center thereof pivotally supported by the rear-side support portion. Further, the rear end of the front-side connecting link bar and the front end of the rear-side connecting link bar are pivotally and slidably connected to each other. The front portion and the rear portion of the key are supported from below by the link mechanism configured as above, whereby when the front end of the key is depressed in key depression, the rear end of the key is moved downward in a manner interlocked with the key depression, while maintaining a constant relationship to the front end of the key.

As described hereinabove, according to the present invention, it is possible to stably obtain the same key operation as that of the keyboard of the grand piano over a long term, in spite of the key being configured such that it has a shorter length than the key of the grand piano. Further, since the key is configured to be short, it is possible to configure keyboard device and the keyboard instrument to which the keyboard device is applied such that they are compact in a depth dimension.

Preferably, the front-side key link bar and the rear-side key link bar are immovably fixed to the key, and one of the front-side connecting link bar and the rear-side connecting link bar is also slidably supported by the front-side support portion or the rear-side support portion.

With the configuration of this preferred embodiment, the front-side key link bar and the rear-side key link bar, which are connected to the front portion and the rear portion of the key, respectively, are immovably fixed to the key. Further, one of the front-side connecting link bar and the rear-side connecting link bar, which are pivotally connected to the front-side key link bar and the rear-side key link bar, respectively, is not only pivotally supported by the front-side support portion or the rear-side support portion, as described above, but also slidably supported thereby. The link mechanism configured as above is capable of realizing a smooth movement of the key while providing the above-described advantageous effects.

Preferably, at least one of the front-side key link bar and the rear-side key link bar is pivotally connected to the key, and the front-side connecting link bar and the rear-side connecting link bar are only pivotally connected to the front-side support portion and the rear-side support portion, respectively.

With the configuration of this preferred embodiment, at least one of the front-side key link bar and the rear-side key link bar is pivotally connected to the key. Further, the front-side connecting link bar and the rear-side connecting link bar are only pivotally connected to the front-side support portion and the rear-side support portion, respectively, and differently from the link mechanism described above, they are not slidably connected to the front-side support portion and the rear-side support portion. The link mechanism thus configured makes it possible to realize a smooth movement of the key while providing the advantageous effects described above.

Preferably, the keyboard device further comprises tension springs each provided in each of the link mechanisms, and located between a first predetermined portion of the front-side connecting link bar, which is rearward of the predetermined portion supported by the front-side support portion, and/or a second predetermined portion of the rear-side connecting link bar, which is forward of the predetermined portion supported by the rear-side support portion, and the base, for urging the first predetermined portion and/or the second predetermined portion downward.

With the configuration of this preferred embodiment, the tension spring is provided at the above-mentioned predetermined location of each of the link mechanisms, that is, between at the first predetermined portion of the front-side connecting link bar, which is rearward of the predetermined portion supported by the front-side support portion, and/or the second predetermined portion of the rear-side connecting link bar, which is forward of the predetermined portion supported by the rear-side support portion, and the base. By urging the above-mentioned first predetermined portion and/or the second predetermined portion downward using the tension spring, such an urging force as causes the front-side connecting link bar and the rear-side connecting link bar to pivotally move in predetermined directions, respectively, acts on the front-side connecting link bar and the rear-side connecting link bar, such that the front end of the front-side connecting link bar and the rear end of the rear-side connecting link bar move upward. As a consequence, the link mechanism causes a force to act on the key to push up the key. Therefore, when a finger is released from the depressed key, the key is pushed up by the link mechanism, whereby the key can properly return to its original position before being depressed.

Preferably, the keyboard device further comprises stoppers each erected on the base between the front-side support portion and the rear-side support portion, and configured such that in a key-released state, a linkage between the front-side connecting link bar and the rear-side connecting link bar is brought into abutment with the stopper from above.

With the configuration of this preferred embodiment, in the key-released state, the linkage between the front-side connecting link bar and the rear-side connecting link bar is brought into abutment with the stopper which is erected on the base between the front-side support portion and the rear-side support portion, from above. In this case, the operations of the link mechanism for pushing up the key, specifically, the pivotal movements of the front-side connecting link bar and the rear-side connecting link bar in the respective predetermined directions are prevented, whereby it is possible to properly position the key in the key-released state at a predetermined height.

Preferably, in place of the front-side key link bar and the rear-side key link bar, a front-side key connecting portion and a rear-side key connecting portion, which protrude downward and are integrally formed with the key, are provided at the front portion and the rear portion of the key, respectively, and the front-side connecting link bar has the front end thereof pivotally connected to the front-side key connecting portion, the rear-side connecting link bar having the rear end thereof pivotally and slidably connected to the rear-side key connecting portion, the keyboard device further comprising weights, each of which is provided in each of the link mechanisms, and is mounted to a third predetermined portion of the front-side connecting link bar, which is rearward of the predetermined portion supported by the front-side support portion, or a fourth predetermined portion of the rear-side connecting link bar, which is forward of the predetermined portion supported by the rear-side support portion, for adding touch weight to the key during key depression.

With the configuration of this preferred embodiment, in place of the front-side key link bar and the rear-side key link bar, the front-side key connecting portion and the rear-side key connecting portion, which protrude downward, are integrally provided with the key at the front portion and the rear portion thereof, respectively. The front end of the front-side connecting link bar is pivotally connected to the front-side key connecting portion, while the rear end of the rear-side connecting link bar is pivotally and slidably connected to the rear-side key connecting portion. The link mechanism thus configured makes it possible to realize a smooth movement of the key while providing the advantageous effects described hereinabove.

Further, the weight for adding the touch weight to the key during key depression is mounted to the predetermined portion of each link mechanism. More specifically, the above-mentioned weight is mounted to the third predetermined portion of the front-side connecting link bar, which is rearward of the predetermined portion supported by the front-side support portion, or the fourth predetermined portion of the rear-side connecting link bar, which is forward of the predetermined portion supported by the rear-side support portion. The own weight of the above-mentioned weight acts on the third predetermined portion of the front-side connecting link bar or the fourth predetermined portion of the rear-side connecting link bar, whereby forces act on the front-side connecting link bar and the rear-side connecting link bar such that the front end of front-side connecting link bar and the rear end of the rear-side connecting link bar move upward. As a consequence, the key is strongly supported from below by the link mechanism, whereby during depression of the key, touch weight as a reaction force against the depression becomes larger. Therefore, by mounting the weight to the predetermined portion of the front-side connecting link bar or the rear-side connecting link bar, it is possible to obtain, when the player depresses the key, sufficient touch weight similar to a case where the player performs key depression on a keyboard of an acoustic piano.

More preferably, the weight includes a first arm extending a predetermined length in the front-rear direction and having a front end fixed to the third predetermined portion, and a first weight body fixed to a rear end of the first arm.

With the configuration of this preferred embodiment, the weight includes the above-mentioned first arm and first weight body. The front end of the first arm which extends in the front-rear direction is fixed to the third predetermined portion of the front-side connecting link bar, and the first weight body is fixed to the rear end of the first arm. With this, during key depression, it is possible to secure the touch weight mentioned above, while causing the first arm and the first weight body to move in unison with the front-side connecting link bar.

More preferably, the weight includes a second arm extending a predetermined length in the front-rear direction and having a rear end fixed to the fourth predetermined portion, and a second weight body fixed to a front end of the second arm.

With the configuration of this preferred embodiment, the weight includes the above-mentioned second arm and second weight body. The rear end of the second arm which extends in the front-rear direction is fixed to the fourth predetermined portion of the rear-side connecting link bar, and the second weight body is fixed to the front end of the second arm. With this, during key depression, it is possible to secure the above-mentioned touch weight, while causing the second arm and the second weight body to move in unison with the rear-side connecting link bar.

The above and other objects, features, and advantages of the present invention will become more apparent from the following detailed description taken in conjunction with the accompanying drawings.

BRIEF DESCRIPTION OF THE DRAWINGS

FIGS. 1A and 1B are side views useful in explaining a keyboard device according to a first embodiment of the present invention, in which FIG. 1A shows the keyboard device in a key-released state and FIG. 1B shows a key and a link mechanism in an exploded state.

FIGS. 2A and 2B are side views showing the movement of the key of the keyboard device according to the first embodiment, in which FIG. 2A shows the key-released state of the key and FIG. 2B shows a key-depressed state.

FIGS. 3A and 3B are side views useful in explaining a keyboard device according to a second embodiment of the present invention, in which FIG. 3A shows a state of the keyboard device as viewed from a left side and FIG. 3B shows a state of the keyboard device as viewed from a right side.

FIGS. 5A and 5B are side views showing the movement of a key of the keyboard device according to the second embodiment, in which FIG. 5A shows a key-released state, and FIG. 5B shows a key-depressed state.

FIGS. 6A and 6B are side views useful in explaining a keyboard device according to a third embodiment of the present invention, in which FIG. 6A shows a state of the keyboard device as viewed from the right side and FIG. 6B shows a state of the keyboard device as viewed from the left side.

FIGS. 8A and 8B are side views showing the movement of the key of the keyboard device according to the third embodiment, in which FIG. 8A shows a key-released state and FIG. 8B shows a key-depressed state.

DETAILED DESCRIPTION OF PREFERRED EMBODIMENTS

Figure 1A:
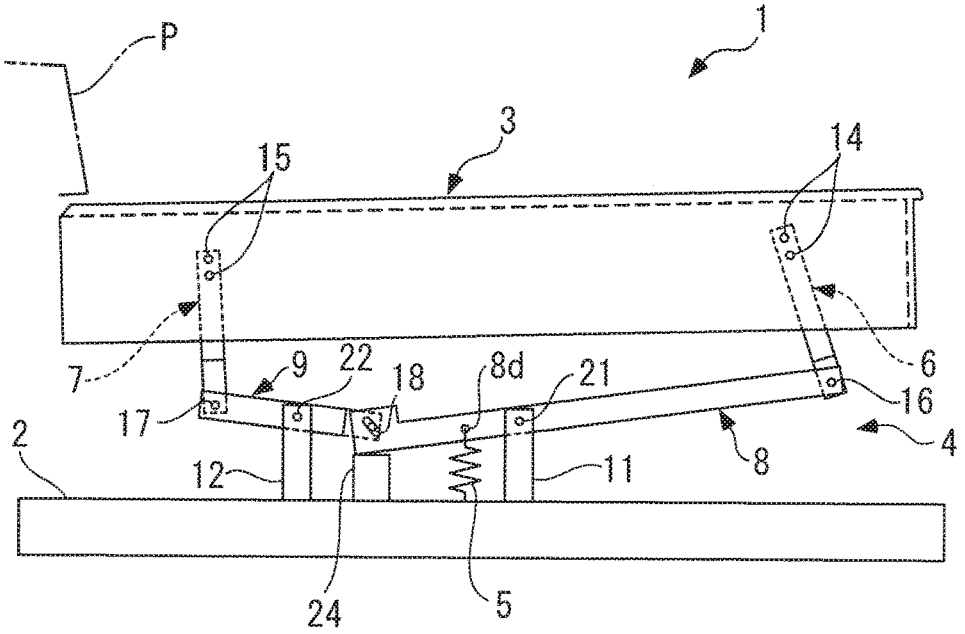
Figure 1B:
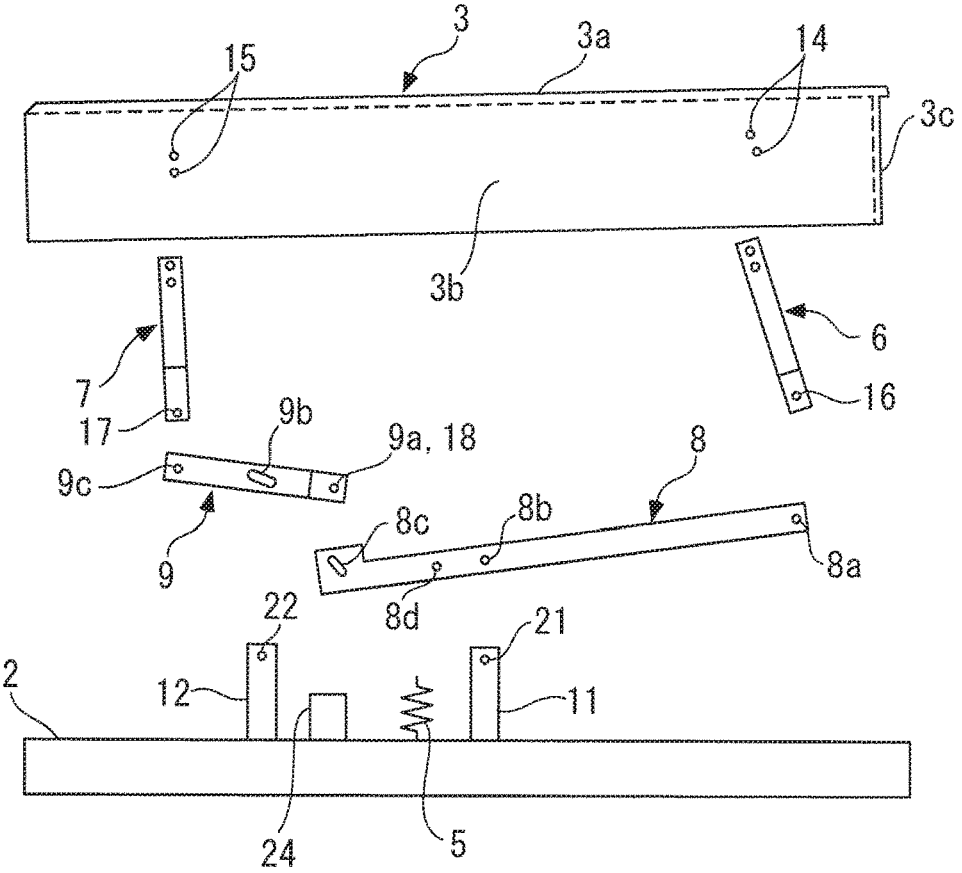

The present invention will now be described in detail with reference to the drawings showing preferred embodiments thereof. FIGS. 1A and 1B are side views of a keyboard device according to a first embodiment of the present invention, in which FIG. 1A shows a key-released state and FIG. 1B shows a key and a link mechanism in an exploded state. The keyboard device 1 is applied to an electronic keyboard instrument, such as an electronic piano.

The keyboard device 1 is comprised of a base 2 in the form of a horizontally-disposed plate, a plurality of keys 3 (only one white key of which is shown in FIGS. 1A and 1B), which are arranged above the base 2 in a state extending in the front-rear direction (in the left-right direction, as viewed in FIG. 1A), respectively, and are juxtaposed side by side in the left-right direction (in the direction toward the far side in FIG. 1A), a plurality of the link mechanisms 4 (only one of which is shown in FIGS. 1A and 1B), each of which is arranged above the base 2 such that it supports an associated one of the keys from below, and a plurality of return springs 5 (only one of which is shown in FIGS. 1A and 1B), each of which is provided between the base 2 and a predetermined portion of an associated one of the link mechanisms 4, for returning a depressed key 3 to a key-released state.

Each key 3 is formed by a molded article e.g. of a synthetic resin and has a predetermined length in the front-rear direction. For example, the key 3 has a length (e.g. 15 cm) which is approximately half of a length from a front end of a key of a general grand piano to a balance pin about which the key swings. Further, the key 3 is formed by an upper wall 3*a*, left and right side walls 3*b* and 3*b*, and a front wall 3*c*, and has a hollow shape opening downward and rearward (leftward, as viewed in FIGS. 1A and 1B).

Each link mechanism 4 includes a front-side key link bar 6 connected to a front portion (right portion in FIGS. 1A and 1B) of the key 3, a rear-side key link bar 7 connected to a rear portion (left portion in FIGS. 1A and 1B) of the key 3, a front-side connecting link bar 8 connected to the front-side key link bar 6, and a rear-side connecting link bar 9 connected to the rear-side key link bar 7. The front-side connecting link bar 8 and the rear-side connecting link bar 9 are connected to each other. Further, the above-mentioned front-side connecting link bar 8 and rear-side connecting link bar 9 are pivotally supported by a front-side support portion 11 and a rear-side support portion 12, both of which are fixed to the base 2, respectively.

As shown in FIGS. 1A and 1B, the front-side key link bar 6, the rear-side key link bar 7, the front-side connecting link bar 8, and the rear-side connecting link bar 9 are each formed e.g. by a long narrow metal plate. The front-side key link bar 6 extends a predetermined length in the vertical direction and an upper end thereof is fixed to a predetermined location of the front portion of the key 3 via two (upper and lower) connecting pins 14 and 14. On the other hand, the rear-side key link bar 7 extends a predetermined length in the vertical direction and an upper end thereof is fixed to a predetermined location of the rear portion of the key 3 via two (upper and lower) connecting pins 15 and 15. Note that in the present embodiment, the front-side key link bar 6 is disposed in an inclined position where a lower end thereof is located slightly forward of the upper end, whereas the rear-side key link bar 7 is disposed in a position substantially along the vertical line.

The front-side connecting link bar 8 extends a predetermined length in the front-rear direction, and has pin holes 8*a* and 8*b* formed therein at a front end and a predetermined location rearward of an approximate longitudinal center thereof, respectively. Further, in a rear end of the front-side connecting link bar 8, there is formed a slot 8*c* which extends a predetermined length in a state inclined with respect to the longitudinal direction of the front-side connecting link bar 8. The front-side connecting link bar 8 is pivotally connected to a lower end of the front-side key link bar 6 by having a front-side connecting pin 16, which is fixed to the lower end of the front-side key link bar 6, inserted into the pin hole 8*a* of the front end of the front-side connecting link bar 8.

On the other hand, the rear-side connecting link bar 9 is shorter than the above-described front-side connecting link bar 8 and also extends a predetermined length in the front-rear direction. The rear-side connecting link bar 9 has pin holes 9*a* and 9*c* formed in a front end and a rear end thereof, respectively. Further, at about the longitudinal center of the rear-side connecting link bar 9, there is formed a slot 9*b* which extends a predetermined length in a state inclined with respect to the longitudinal direction of the rear-side connecting link bar 9. The rear-side connecting link bar 9 is pivotally connected to a lower end of the rear-side key link bar 7 by having a rear-side connecting pin 17, which is fixed to the lower end of the rear-side key link bar 7, inserted into the pin hole 9*c* of the rear end of the rear-side connecting link bar 9. In addition, a center connecting pin 18 fixed to the pin hole 9*a* of the front end of the rear-side connecting link bar 9 is inserted into the slot 8*c* formed in the rear end of the front-side connecting link bar 8. With this, the rear end of the front-side connecting link bar 8 and the front end of the rear-side connecting link bar 9 are pivotally and slidably connected to each other. Note that the ratio of the length of the front-side connecting link bar 8 and the length of the rear-side connecting link bar 9 is set to approximately 2:1.

Further, the front-side support portion 11 and the rear-side support portion 12 are each fixed to the base 2 in an erected state and are arranged with a predetermined spacing therebetween in the front-rear direction. Upper ends of the front-side support portion 11 and the rear-side support portion 12 are each formed into e.g. a U shape in front view, as viewed from the front (right in FIGS. 1A and 1B), and are configured to hold the front-side connecting link bar 8 and the rear-side connecting link bar 9 in a state sandwiching the two bars 8 and 9 from the left and the right, respectively.

Specifically, in a state in which a front-side support pin 21 fixed to the upper end of the front-side support portion 11 is inserted into the pin hole 8*b* located toward the center of the front-side connecting link bar 8, the front-side connecting link bar 8 is pivotally supported by the upper end of the front-side support portion 11. On the other hand, in a state in which a rear-side support pin 22 fixed to the upper end of the rear-side support portion 12 is inserted into the slot 9*b* located toward the center of the rear-side connecting link bar 9, the rear-side connecting link bar 9 is pivotally and slidably supported by the upper end of the rear-side support portion 12.

Further, the return spring 5 is formed by a tension spring, and is mounted between a spring mounting hole 8*d* (first predetermined portion) formed rearward of the pin hole 8*b* of the front-side connecting link bar 8 supported by the front-side support portion 11, and the base 2. The return spring 5 urges downward a portion of the front-side connecting link bar 8 where the spring mounting hole 8*d* is formed.

Further, a stopper 24 is erected on the base 2 between the front-side support portion 11 and the rear-side support portion 12. In the key-released state, a linkage between the front-side connecting link bar 8 and the rear-side connecting link bar 9 is brought into abutment with the stopper 24 from above. More specifically, the rear end of the front-side connecting link bar 8 and/or the front end of the rear-side connecting link bar 9 are/is brought into abutment with the stopper 24 from above. This prevents counterclockwise pivotal movement of the front-side connecting link bar 8 and clockwise pivotal movement of the rear-side connecting link bar 9, whereby the key 3 is held at a predetermined height in the key-released state.

The electronic keyboard instrument to which the keyboard device 1 constructed as above is applied is covered by an exterior casing (not shown) such that the link mechanisms 4, the return springs 5, and the like below the keys 3 are concealed from outside. Further, on the rear sides of the keys 3, there is provided a front panel P which is erected from about rear ends of upper surfaces of the keys 3 and forms part of the exterior casing. Therefore, in this keyboard device 1, almost the whole of each key 3 is exposed to the outside.

Figure 2B:
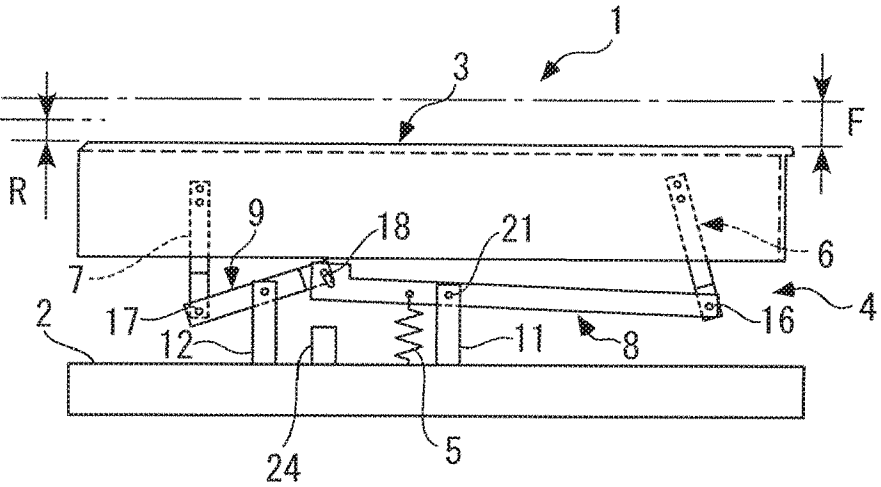
Figure 2A:
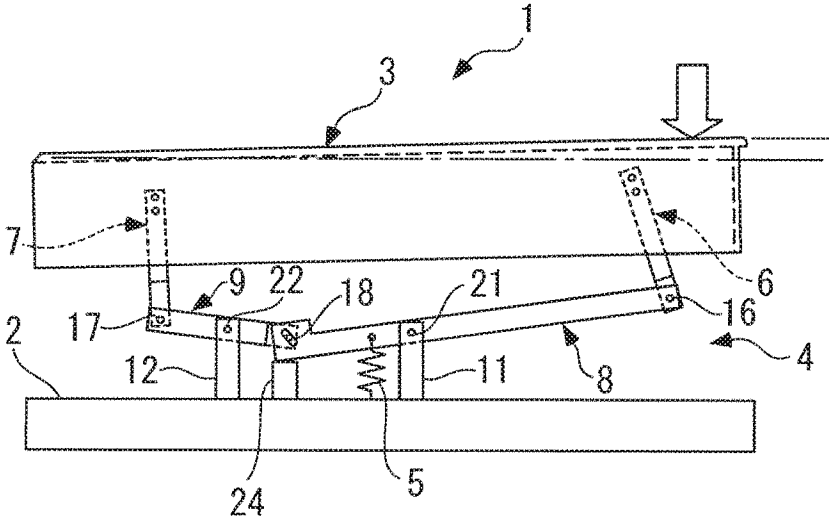

Next, the movement of the key 3 of the keyboard device 1 caused by key depression will be described with reference to FIGS. 2A and 2B. FIGS. 2A and 2B show the key-released state in which the front end of the key 3 is not depressed and the key-depressed state in which the key 3 is depressed, respectively.

When the front end of the key 3 is depressed e.g. by a finger of a player, as indicated by a hollow arrow in FIG. 2A, the front-side key link bar 6 fixed to the key 3 is moved downward in unison with the key 3, whereby the front-side connecting link bar 8 is pivotally moved clockwise about the above-mentioned front-side support pin 21, against the urging force of the return spring 5. Further, in accordance with the above-mentioned pivotal movement of the front-side connecting link bar 8, the front end of the rear-side connecting link bar 9 connected to the rear end of the front-side connecting link bar 8 via the center connecting pin 18 is moved upward. With this, the rear-side connecting link bar 9 is pivotally moved counterclockwise about the rear-side support pin 22. Then, in accordance with this pivotal movement of the rear-side connecting link bar 9, the rear-side key link bar 7 connected to the rear end of the rear-side connecting link bar 9 via the rear-side connecting pin 17 is pulled down, whereby the rear end of the key 3 to which the rear-side key link bar 7 is fixed is moved downward.

As shown in FIG. 2B, when the front end of the key 3 is depressed to the lowest position, compared with the case where the key 3 is in the key-released state shown in FIG. 2A, the front end is located lower by a distance F (e.g. 10 mm) and that of the rear end of the key 3 is located lower by a distance R (e.g. 5 mm), which is approximately half of the distance F.

On the other hand, when the finger is released from the depressed key 3, the front-side connecting link bar 8 of the link mechanism 4 pivotally moves in a direction opposite to the above-mentioned direction, by the urging force of the return spring 5, and in accordance therewith, the rear-side connecting link bar 9 as well pivotally moves in a direction opposite to the above-mentioned direction. Then, the linkage between the rear end of the front-side connecting link bar 8 and the front end of the rear-side connecting link bar 9 is brought into abutment with the stopper 24 from above, whereby further pivotal movement of the two connecting link bars 8 and 9 is blocked. By the above operation of the link mechanism 4, the key 3 is moved upward to return to its original key-released state.

As described above, according to the present embodiment, the the key 3 is stably supported from below by the link mechanism 4 at two locations i.e. at the front and rear locations, and hence differently from the conventional keyboard device in which a rear end of a key is supported in a cantilever state, it is possible to ensure a stable movement of the key 3. Further, the link mechanism 4 is configured such that when the front end of the key 3 is depressed, the amount of downward movement of the rear end thereof becomes approximately half of the amount of downward movement of the front end.

Therefore, although each key 3 of the present embodiment is configured to be relatively short, i.e. to have almost the same length as the length of a portion, exposed to the outside, of a key of the grand piano, an associated one of the link mechanisms 4 makes the amount of downward movement of the rear end of the key 3 caused by key depression equal to approximately half of the amount of downward movement of the front end of the key 3, and hence upon key depression, it is possible to realize the same key operation as that of the key of the grand piano. From the above, in the present embodiment, it is possible to stably obtain the same key operation as that of the keyboard of the grand piano over a long term, in spite of the key 3 being configured such that it has a shorter length than that of the key of the grand piano. Further, since the key 3 is configured to have a short length, the keyboard device 1 and the depth of the keyboard instrument to which the keyboard device 1 is applied can be configured to be compact in depth.

Note that the present invention is not limited to the above-described first embodiment, but it can be practiced in various forms. For example, although in the first embodiment, both the upper ends of the front-side key link bar 6 and the rear-side key link bar 7 are fixed to the key 3, it is possible to pivotally connect at least one of the two key link bars 6 and 7 to the key 3. In this case, in the rear-side connecting link bar 9, a pin hole similar to the pin holes 9*a* and 9*c* of the front and rear ends is formed in place of the slot 9*b* in the center of the rear-side connecting link bar 9, and the rear-side support pin 22 of the rear-side support portion 12 is inserted into the pin hole, whereby the rear-side connecting link bar 9 is only pivotally connected to the rear-side support portion 12. Also in the case where the link mechanism 4 is configured as above, it is possible to realize a smooth movement of the key 3 while obtaining the same advantageous effects as obtained by the above-described embodiment.

Further, although in the first embodiment, the return spring 5 for returning the depressed key 3 to its original key-released state is provided only at the predetermined portion of the front-side connecting link bar 8, the present invention is not limited to this, but it is possible to provide the return spring 5 at any other portion of the link mechanism 4 insofar as the return spring 5 provided at the portion causes the link mechanism 4 to operate such that the key 3 is returned to its original key-released state. For example, the return spring 5 may be provided at a portion (second predetermined portion) of the rear-side connecting link bar 9, forward of the slot 9*b* in the center thereof, in place of or in addition to the predetermined portion of the front-side connecting link bar 8.

Further, although synthetic resin is mentioned, by way of example, as the material of the key 3, the material of the key 3 is not limited to this, but it is possible to form the key 3 using any other suitable material (e.g. composite material). Further, although metal is mentioned as the material of the link bars 6, 7, 8 and 9, by way of example, the material of the link bars is not limited to this, but it is possible to form the link bars using any other suitable material (e.g. carbon fiber resin). Furthermore, the positions of the link bars in the key-released state and the extension directions and lengths of the slots formed in the link bars can be changed, as required.

Next, a keyboard device according to a second embodiment of the present invention will be described with reference to FIGS. 3A to 5B. Similar to the above-described first embodiment, the keyboard device 31 is applied to an electronic keyboard instrument, such as an electronic piano. Further, the keyboard device 31 is distinguished from the keyboard device 1 of the first embodiment in that the return springs 5 and the stoppers 24 are omitted and weights are mounted to the link mechanisms.

Figure 3A:
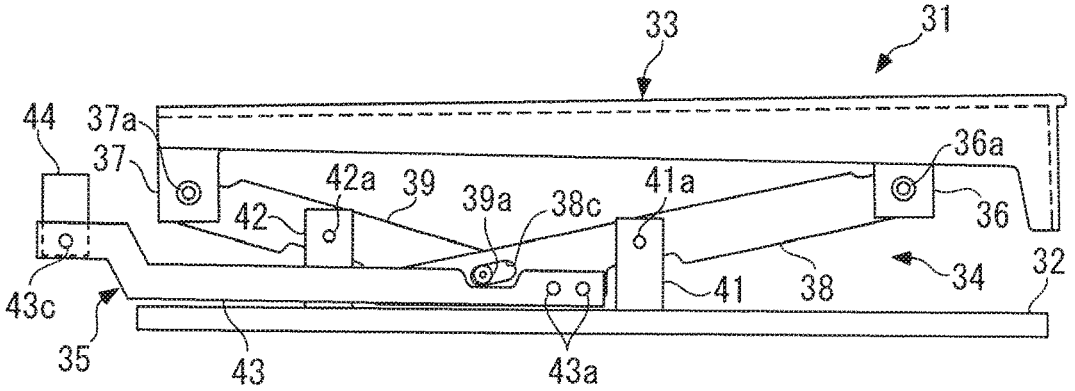
Figure 3B:
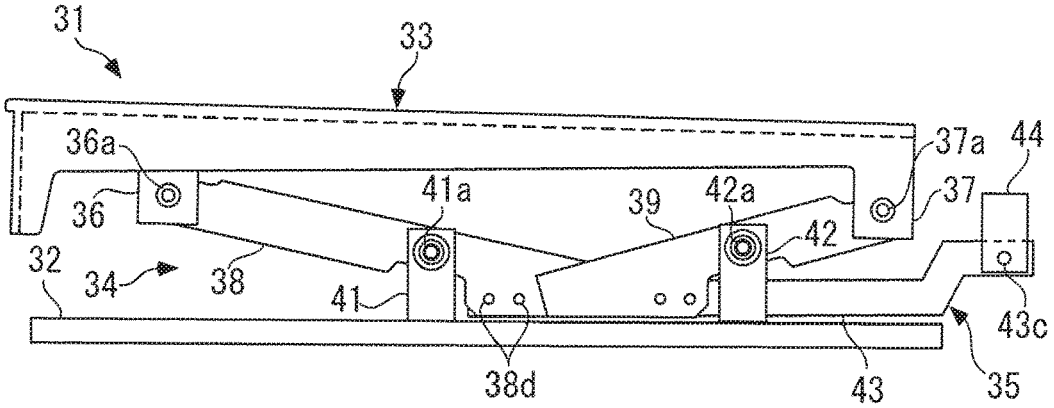
Figure 4:
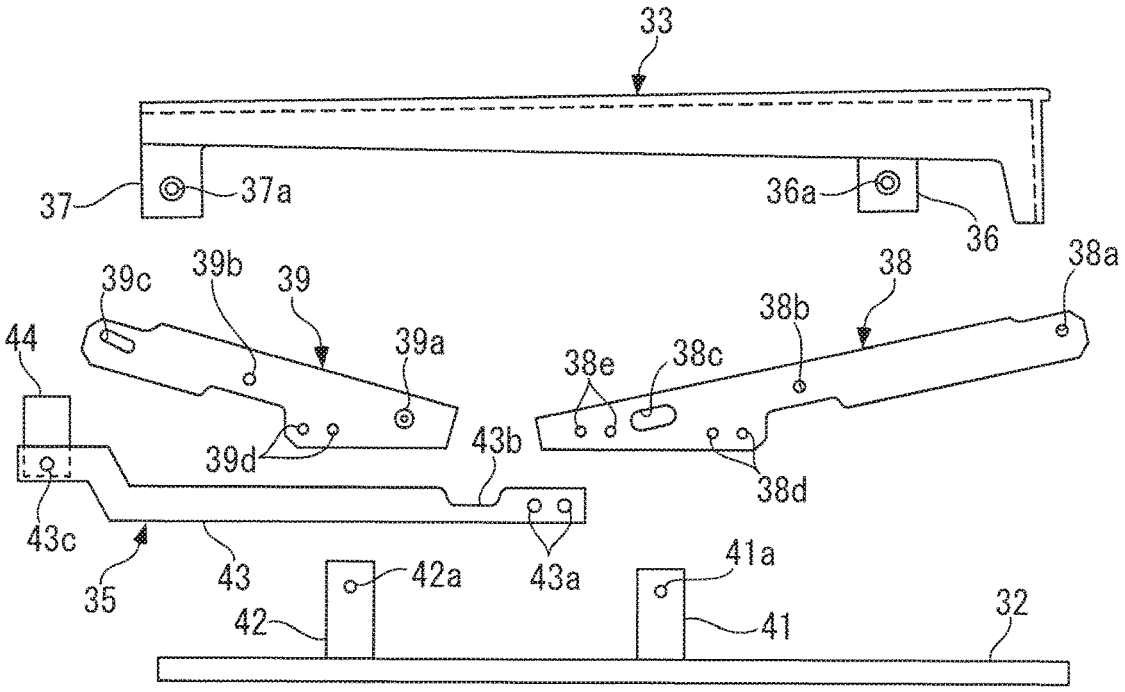
FIG. 4 is a side view of the keyboard device in which a key, a link mechanism, and a weight, appearing in FIG. 3A, are illustrated in an exploded state.

FIGS. 3A and 3B shows states of the keyboard device 31 according to the second embodiment, as viewed from the left side and the right side, respectively. FIG. 4 shows a key 33, a link mechanism 34, and a weight 35 of the keyboard device 31 shown in FIG. 3A, in an exploded state. As shown in FIGS. 3A to 4, the keyboard device 31 includes a base 32, the key 33, and the link mechanism 34, which correspond to the base 2, the key 3, and the link mechanism 4 of the keyboard device 1 according to the above-described first embodiment, respectively, and further includes the weight 35 mounted to a predetermined portion of the link mechanism 34.

Similar to the key 3 of the first embodiment, the key 33 is formed by a molded article e.g. of a synthetic resin, and has a predetermined length in the front-rear direction. The key 33 has a hollow shape opening downward and rearward (leftward as viewed in FIG. 3A and rightward as viewed in FIG. 3B). On a front portion and a rear end of the key 33, there are provided a front-side key connecting portion 36 and a rear-side key connecting portion 37, respectively, which protrude downward and are connected to the link mechanism 34. These front-side key connecting portion 36 and the rear-side key connecting portion 37 are integrally formed with the key 33.

The link mechanism 34 includes a front-side connecting link bar 38 and a rear-side connecting link bar 39, which correspond to the front-side connecting link bar 8 and the rear-side connecting link bar 9 of the link mechanism 4 of the first embodiment, respectively. The front-side connecting link bar 38 and the rear-side connecting link bar 39 are each formed e.g. by a long narrow metal plate and have respective predetermined shapes shown in FIG. 4.

As shown in FIG. 4, the front-side connecting link bar 38 extends a predetermined length in the front-rear direction and has pin holes 38*a* and 38*b* formed in a front end (right end as viewed in FIG. 4) and at about the longitudinal center thereof, respectively. Further, in a rear portion (left portion as viewed in FIG. 4) of the front-side connecting link bar 38, there is formed a slot 38*c* which extends a predetermined length along the longitudinal direction of the front-side connecting link bar 38. Furthermore, two pairs of weight mounting holes 38*d* and 38*d*, and 38*e* and 38*e* for mounting the weights 35 are formed in the rear portion of the front-side connecting link bar 38, at respective locations forward and rearward of the above-mentioned slot 38*c*. The front-side connecting link bar 38 is pivotally connected to the front-side key connecting portion 36 by inserting a front-side connecting pin 36*a* fixed to the front-side key connecting portion 36 of the key 33 into the pin hole 38*a* of the front end of the front-side connecting link bar 38.

On the other hand, the rear-side connecting link bar 39 is shorter than the above-described front-side connecting link bar 38 and extends a predetermined length in the front-rear direction. Further, the rear-side connecting link bar 39 has a front end thereof formed with a center connecting pin 39*a* that protrudes leftward (toward a near side as viewed in FIG. 4) by a predetermined length, and has a pin hole 39*b* formed at about the longitudinal center thereof and a slot 39*c* formed in a rear end thereof. Furthermore, in a front portion of the rear-side connecting link bar 39, there are formed two weight mounting holes 39*d* and 39*d*. The rear-side connecting link bar 39 is pivotally and slidably connected to the rear-side key connecting portion 37 by inserting a rear-side connecting pin 37*a* fixed to the rear-side key connecting portion 37 of the key 33 into the slot 39*c* of the rear end of the rear-side connecting link bar 39. In addition, the rear-side connecting link bar 39 has the center connecting pin 39*a* of the front end thereof inserted into the slot 38*c* of the rear portion of the front-side connecting link bar 38. With this, a rear end of the front-side connecting link bar 38 and a front end of the rear-side connecting link bar 39 are pivotally and slidably connected to each other.

On the base 32, there are erected a front-side support portion 41 and a rear-side support portion 42, which are configured similar to the front-side support portion 11 and the rear-side support portion 12 of the above-described first embodiment, respectively. The front-side connecting link bar 38 is pivotally supported by an upper end of the front-side support portion 41 in a state in which a front-side support pin 41*a* fixed to an upper end of the front-side support portion 41 is inserted into the pin hole 38*b* located toward the center of the front-side connecting link bar 38. On the other hand, the rear-side connecting link bar 39 is pivotally supported by an upper end of the rear-side support portion 42 in a state in which a rear-side support pin 42*a* fixed to the upper end of the rear-side support portion 42 is inserted into the pin hole 39*b* located toward the center of the rear-side connecting link bar 39.

Further, the weight 35 is mounted to the rear portion of the front-side connecting link bar 38, more specifically, on a predetermined portion (third predetermined portion) rearward (leftward as viewed in FIG. 4) of the pin hole 38*b* located at about the center. The weight 35 is comprised of an arm 43 extending a predetermined length in the front-rear direction and a weight body 44 fixed to a rear end of the arm 43.

The arm 43 is formed e.g. by a long narrow aluminum plate, and as shown in FIG. 4, has two (front and rear) mounting pins 43*a* and 43*a* formed on a front end thereof. Further, the arm 43 has a recess 43*b* formed at a location immediately rearward of the mounting pins 43*a* (see FIGS. 3A and 4), for avoiding interference with the center connecting pin 39*a* of the rear-side connecting link bar 39. Furthermore, a rear portion of the arm 43 is formed to bend obliquely upward and then extend rearward, and the weight body 44 is fixed to the rear end of the arm 43 via a mounting pin 43*c*. On the other hand, the weight body 44 is formed by a metal plate (e.g. iron plate) having a relatively large specific gravity and is formed to have a predetermined size and shape (rectangular shape, in the present embodiment).

The weight 35 constructed as above is mounted to the front-side connecting link bar 38 by fitting the two mounting pins 43*a* and 43*a* of a front end of the arm 43 into the weight mounting holes 38*d* and 38*d* on a front side formed in the rear portion of the front-side connecting link bar 38. In this case, as shown in FIGS. 3A and 3B, the arm 43 of the weight 35 extends in the front-rear direction with a slight gap between the same and the base 32, with a rear portion of the arm 43 protruding rearward of a rear end of the key 33 and the weight body 44 being located rearward of the key 33.

Figure 5B:
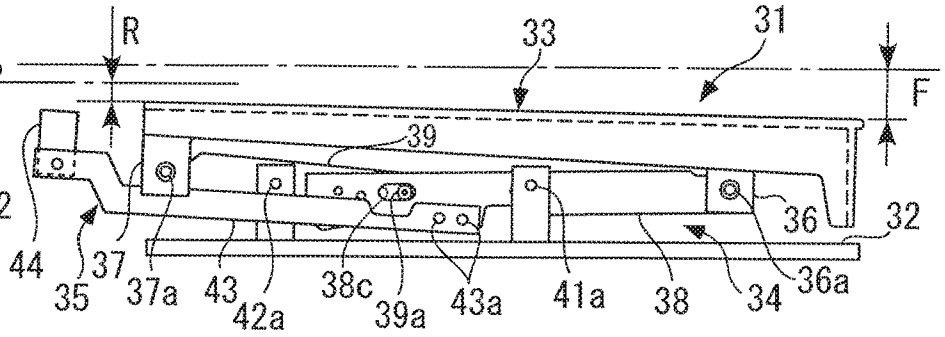
Figure 5A:
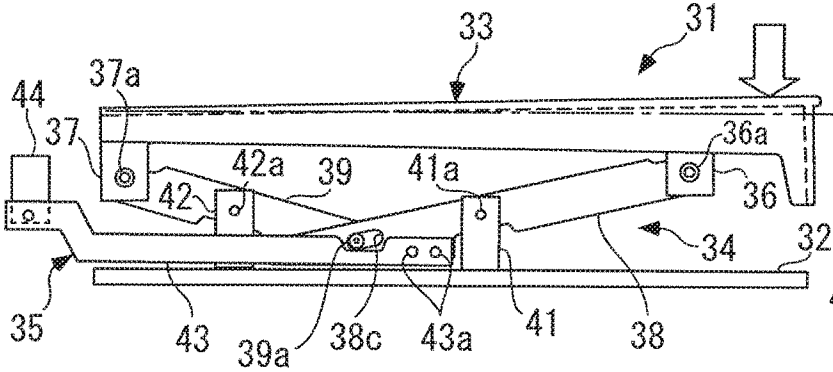

FIGS. 5A and 5B show a key-released state and a key-depressed state of the key 33 of the keyboard device 31, respectively. When a front end of the key 33 is depressed e.g. by a finger of a player, as indicated by a hollow arrow in FIG. 5A, the front-side key connecting portion 36 integrally mounted to the key 33 is moved downward, whereby the front-side connecting link bar 38 is pivotally moved clockwise about the front-side support pin 41*a*. Further, in accordance with the above-mentioned pivotal movement of the front-side connecting link bar 38, the front end of the rear-side connecting link bar 39 connected to the rear end of the front-side connecting link bar 38 via the center connecting pin 39*a* is moved upward. With this, the rear-side connecting link bar 39 is pivotally moved counterclockwise about the rear-side support pin 42*a*. Then, in accordance with the pivotal movement of the rear-side connecting link bar 39, the rear-side key connecting portion 37 connected to the rear end of the rear-side connecting link bar 39 via the rear-side connecting pin 37*a* is pulled down, whereby the rear end of the key 33 integrally formed with the rear-side key connecting portion 37 is moved downward.

As described above, in a case where the key 33 is depressed, in accordance with the clockwise pivotal movement of the front-side connecting link bar 38, the arm 43, which was in a horizontal position, of the weight 35 is slightly inclined rearward and upward, whereby the weight body 44 provided on the rear end of the arm 43 is moved upward, as shown in FIG. 5B. In this case, the own weight of the weight 35 acts on the rear portion of the front-side connecting link bar 38, whereby forces act on the front-side connecting link bar 38 and the rear-side connecting link bar 39 such that the front end of front-side connecting link bar 38 and the rear end of the rear-side connecting link bar 39 move upward. As a consequence, the key 33 is strongly supported from below by the link mechanism 34, whereby when the key 33 is depressed, touch weight as a reaction force against the depression becomes larger.

Further, as shown in FIG. 5B, when the front end of the key 33 is depressed to the lowest position, compared with the case where the key 33 is in the key-released state in FIG. 5A, the front end is located lower by a distance F (e.g. 10 mm) and the rear end of the key 33 is located lower by a distance R (e.g. 5 mm), which is approximately half of the distance F.

On the other hand, when the finger is released from the depressed key 33, the front-side connecting link bar 38 of the link mechanism 34 pivotally moves in a direction opposite to the above-mentioned direction by the own weight of the weight 35, and in accordance therewith, the rear-side connecting link bar 39 as well pivotally moves in a direction opposite to the above-mentioned direction. In addition, the arm 43, which was in the position inclined rearward and upward, of the weight 35 returns to its original horizontal position in accordance with the pivotal movement of the front-side connecting link bar 38. Then, a lower surface of the rear portion of the front-side connecting link bar 38 and/or a lower surface of the front portion of the rear-side connecting link bar 39 are/is brought into abutment with an upper surface of the base 32, whereby further pivotal movement of the two connecting link bars 38 and 39 is prevented. The above-described operation of the link mechanism 34 causes the key 33 to move upward and return to its original key-released state.

As described hereinabove, according to the present embodiment, similar to the above-described first embodiment, it is possible to stably obtain the same key operation as that of the keyboard of the grand piano over a long term, in spite of the key 33 being configured such that it has a shorter length than that of the key of the grand piano. Further, since the key 33 is configured to have a short length, the keyboard device 31 and the depth of the keyboard instrument to which the keyboard device 31 is applied can be configured to be compact in depth. Further, by mounting the weight 35 to a predetermined portion of the rear portion of the front-side connecting link bar 38, it is possible for the player to obtain, when depressing the key 33, sufficient touch weight similar to a case where the player depresses a keyboard of an acoustic piano.

Next, a third embodiment of the present invention will be described with reference to FIGS. 6A to 8B. The third embodiment is different from the above-described second embodiment only in the shape and mounting position of an arm of a weight mounted to the link mechanism 34. Therefore, the following description is given mainly of different points from the second embodiment. The same component elements as those of the second embodiment are denoted by the same reference numerals and detailed description thereof will be omitted. Furthermore, in the following description, a left side and a right side, as viewed in FIG. 6A, will be referred to as "front" and "rear", respectively.

Figure 6A:
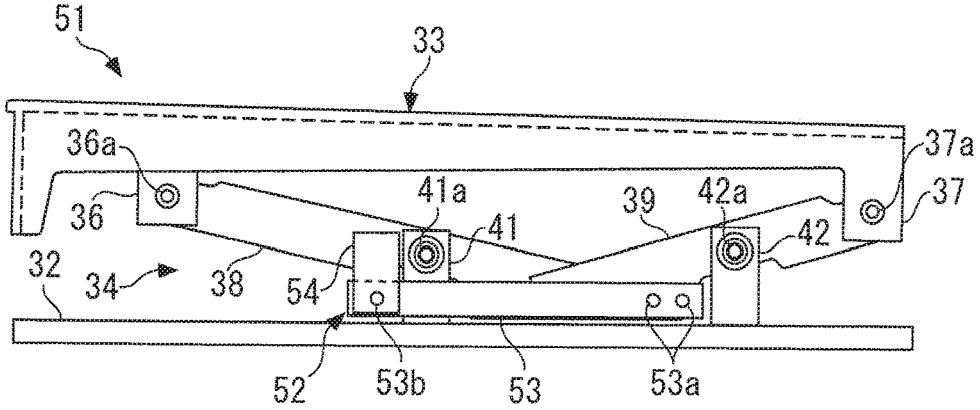
Figure 6B:
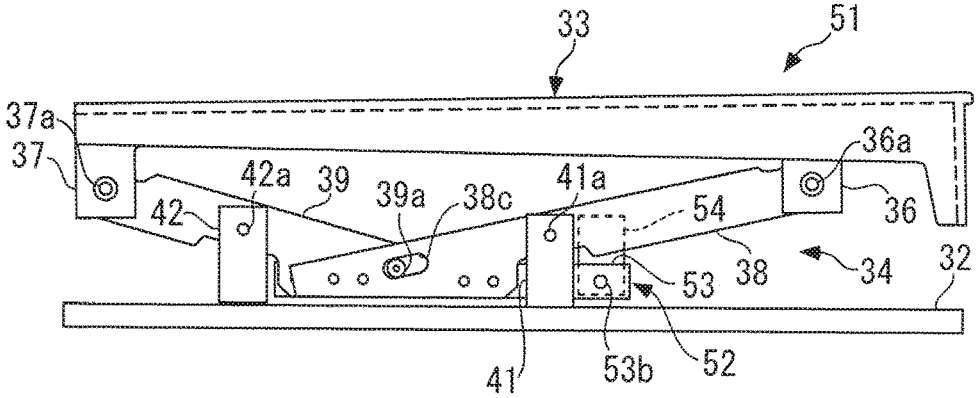
Figure 7:
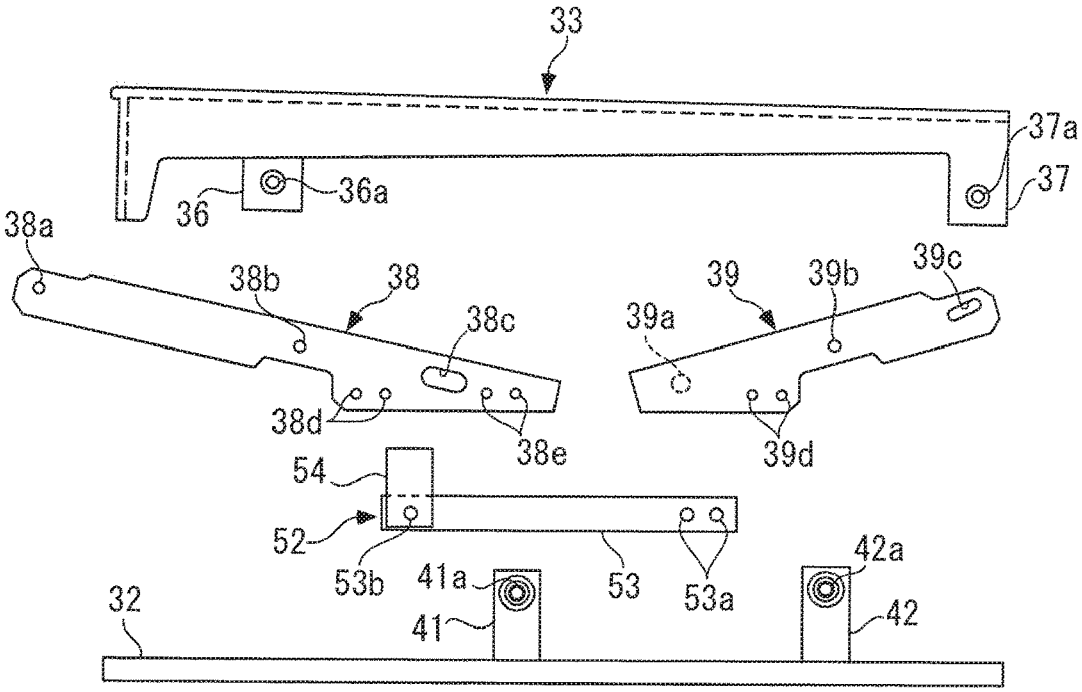
FIG. 7 is a side view of the keyboard device in which a key, a link mechanism, and a weight, appearing in FIG. 6A, are illustrated in an exploded state.

FIGS. 6A and 6B show states of a keyboard device 51 of the third embodiment, as viewed from the right side and the left side, respectively. FIG. 7 shows the key 33, the link mechanism 34, and a weight 52 of the keyboard device 51 shown in FIG. 6A, in an exploded state. The weight 52 of the present embodiment is mounted to the front portion (left portion as viewed in each of FIGS. 6A and 7) of the rear-side connecting link bar 39, more specifically, on a predetermined portion (fourth predetermined portion) forward of the pin hole 39*b* provided at about the center. This weight 52 is comprised of an arm 53 extending a predetermined length in the front-rear direction and a weight body 54 fixed to a front end (left end as viewed in each of FIGS. 6A and 7) of the arm 53.

The arm 53 is formed e.g. by a long narrow aluminum plate and has a predetermined length shorter than that of the arm 43 of the second embodiment. Further, on a rear end (right end as viewed in each of FIGS. 6A and 7) of the arm 53, there are provided two (front and rear) mounting pins 53*a* and 53*a*. On the other hand, the weight body 54 is formed by a metal plate (e.g. iron plate) having a relatively large specific gravity and is formed to have a predetermined size and shape (rectangular shape, in the present embodiment). The weight body 54 is mounted to a front end of the arm 53 via a mounting pin 53*b*.

As shown in FIGS. 6A and 7, the above-described weight 52 is mounted to the rear-side connecting link bar 39 by fitting the two mounting pins 53*a* and 53*a* provided on the rear end of the arm 53 into the weight mounting holes 39*d* and 39*d* formed in the front portion of the rear-side connecting link bar 39. In this case, as shown in FIGS. 6A and 6B, the arm 53 of the weight 52 extends in the front-rear direction with a slight gap between the same and the base 32, and the weight body 54 at the front end of the arm 53 is located at about the longitudinal center of the key 33.

Figure 8B:
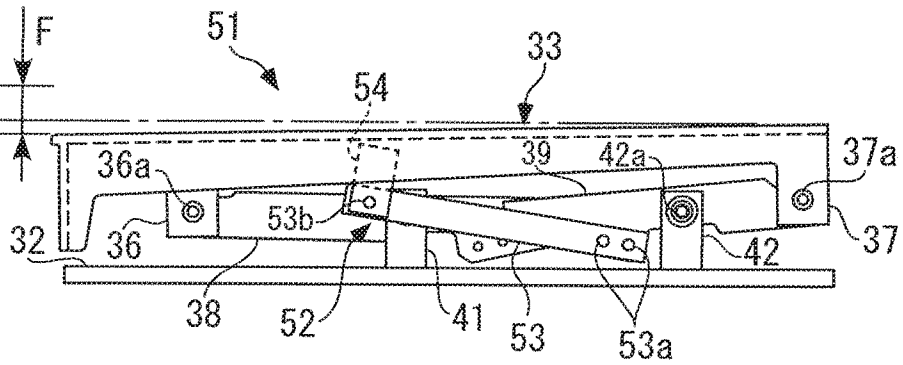
Figure 8A:
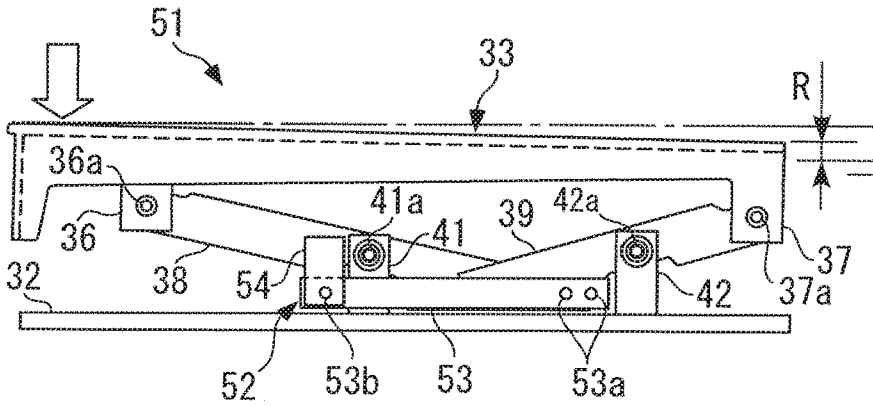

FIGS. 8A and 8B show a key-released state and a key-depressed state of the key 33 of the keyboard device 51, respectively. When the front end of the key 33 is depressed, as indicated by a hollow arrow in FIG. 8A, similar to the above-described second embodiment, the front-side connecting link bar 38 pivotally moves about the front-side support pin 41*a* in a predetermined direction and the rear-side connecting link bar 39 pivotally moves about the rear-side support pin 42*a* in a predetermined direction. In accordance therewith, the rear end of the key 33 is moved downward. Further, in this case, in accordance with clockwise pivotal movement of the rear-side connecting link bar 39, the arm 53, which was in the horizontal position, of the weight 52 is slightly inclined forward and upward, whereby the weight body 54 provided on the front end of the arm 53 is moved upward to enter the inside of the key 33.

Further, as shown in FIG. 8B, when the front end of the key 33 is depressed to the lowest position, compared with the case where the key 33 is in the key-released state in FIG. 8A, the front end is located lower by a distance F (e.g. 10 mm) and the rear end of the key 33 is located lower by a distance R (e.g. 5 mm), which is approximately half of the distance F.

As described hereinbefore, according to the present embodiment, it is possible to obtain the same advantageous effects as obtained by the second embodiment. In addition, in the present embodiment, differently from the weight 35 of the second embodiment, the whole of the weight 52 is located below the key 33 and is prevented from protruding rearward of the rear end of the key 33, and hence there is no need to ensure a movable space of the weight at a location rearward of the key 33.

Note that the present invention is not limited to the above-described second and third embodiments, but it can be practiced in various forms. For example, although in the second embodiment, the weight 35 is mounted to the rear portion of the front-side connecting link bar 38, and in the third embodiment, the weight 52 is mounted to the front portion of the rear-side connecting link bar 39, the above-mentioned two weights 35 and 52 can be mounted to the link mechanism 34 that supports the key 33 which is single. Further, although in the second embodiment, the front end of the arm 43 of the weight 53 is mounted to the front-side connecting link bar 38 via the weight mounting holes 38*d* and 38*d*, on the front side, of the front-side connecting link bar 38, it is possible to mount the weight 35 via the weight mounting holes 38*e* and 38*e*, on a rear side, of the front-side connecting link bar 38, which are provided close to the rear end. Further, although in the second and third embodiments, as the material of the arms 43 and 53 of the weights 35 and 52, an aluminum plate is mentioned, by way of example, the present invention is not limited to this, but it is possible to employ a material (e.g. iron) having a larger specific gravity than aluminum in order to increase the whole weight of the weights 35 and 52.

Furthermore, it is possible to adjust the lengths of the arms 43 and 53 of the weights 35 and 52 and the weights of the weight bodies 44 and 54, as required, whereby touch weight of each key 33 can be adjusted.

Further, although in the above-described embodiments, the description is given of cases where the keyboard device of the present invention is applied to the electronic keyboard instrument, this is not limitative, but the present invention can also be applied to a practice keyboard device that does not emit sound, by way of example. What is more, the detailed structure of each of the keyboard devices 1, 31, and 51, and the link mechanisms 4 and 34 in the embodiments are described only by way of example, and they can be modified, as desired, within the scope of the subject matter of the present invention.

It is further understood by those skilled in the art that the foregoing are preferred embodiments of the invention, and that various changes and modifications may be made without departing from the spirit and scope thereof.

What is claimed is:

1. A keyboard device comprising:

a base;

a plurality of keys provided above the base, each extending a predetermined length in a front-rear direction, the keys being arranged in a state juxtaposed with respect to each other in a left-right direction; and a plurality of link mechanisms each provided on the base, for supporting an associated one of the keys from below, and for causing the associated key to operate such that when a front end of the key is depressed, an amount of downward movement of a rear end of the key becomes approximately half of an amount of downward movement of the front end of the key, wherein the link mechanisms each include:

a front-side support portion and a rear-side support portion provided on the base with a predetermined spacing therebetween in the front-rear direction, a front-side key link bar extending a predetermined length in a vertical direction and having an upper end thereof connected to a front portion of the key, a rear-side key link bar extending a predetermined length in the vertical direction and having an upper end thereof connected to a rear portion of the key, a front-side connecting link bar extending a predetermined length in the front-rear direction, having a front end thereof pivotally connected to a lower end of the front-side key link bar, and a predetermined portion toward a longitudinal center thereof pivotally supported by the front-side support portion, and a rear-side connecting link bar shorter than the front-side connecting link bar and also extending a predetermined length in the front-rear direction, having a rear end thereof pivotally connected to a lower end of the rear-side key link bar, and a predetermined portion toward a longitudinal center thereof pivotally supported by the rear-side support portion, and wherein the front-side connecting link bar and the rear-side connecting link bar are pivotally and slidably connected to each other via a rear end of the front-side connecting link bar and a front end of the rear-side connecting link bar.

2. The keyboard device according to claim 1, wherein the front-side key link bar and the rear-side key link bar are immovably fixed to the key, and wherein one of the front-side connecting link bar and the rear-side connecting link bar is also slidably supported by the front-side support portion or the rear-side support portion.

3. The keyboard device according to claim 1, wherein at least one of the front-side key link bar and the rear-side key link bar is pivotally connected to the key, and wherein the front-side connecting link bar and the rear-side connecting link bar are pivotally connected to the front-side support portion and the rear-side support portion, respectively.

4. The keyboard device according to claim 1, further comprising tension springs each provided in each of the link mechanisms, and located between a first predetermined portion of the front-side connecting link bar, which is rearward of the predetermined portion supported by the front-side support portion, or a second predetermined portion of the rear-side connecting link bar, which is forward of the predetermined portion supported by the rear-side support portion, and the base, for urging the first predetermined portion and/or the second predetermined portion downward.

5. The keyboard device according to claim 1, further comprising stoppers each erected on the base between the front-side support portion and the rear-side support portion, and configured such that in a key-released state, a linkage between the front-side connecting link bar and the rear-side connecting link bar is brought into abutment with the stopper from above.

6. The keyboard device according to claim 1, wherein in place of the front-side key link bar and the rear-side key link bar, a front-side key connecting portion and a rear-side key connecting portion, which protrude downward and are integrally formed with the key, are provided at the front portion and the rear portion of the key, respectively, wherein the front-side connecting link bar has the front end thereof pivotally connected to the front-side key connecting portion, and wherein the rear-side connecting link bar has the rear end thereof pivotally and slidably connected to the rear-side key connecting portion, the keyboard device further comprising weights, each of which is provided in each of the link mechanisms, and is mounted to a third predetermined portion of the front-side connecting link bar, which is rearward of the predetermined portion supported by the front-side support portion, or a fourth predetermined portion of the rear-side connecting link bar, which is forward of the predetermined portion supported by the rear-side support portion, for adding touch weight to the key during key depression.

7. The keyboard device according to claim 6, wherein the weight includes: a first arm extending a predetermined length in the front-rear direction and having a front end fixed to the third predetermined portion, and a first weight body fixed to a rear end of the first arm.

8. The keyboard device according to claim 6, wherein the weight includes: a second arm extending a predetermined length in the front-rear direction and having a rear end fixed to the fourth predetermined portion, and a second weight body fixed to a front end of the second arm.

* * * * *